United States Patent [19]

Weitz

[11] 4,423,098

[45] Dec. 27, 1983

[54] CONNECTORS FOR ASSEMBLING COMPONENT PARTS OF ARTIFICIAL PLANTS

[76] Inventor: Henry Weitz, Prosperity House, 11th Floor, 8A-10 Granville Rd., Kowloon, Hong Kong

[21] Appl. No.: 458,303

[22] Filed: Jan. 17, 1983

[51] Int. Cl.[3] ..... A41G 1/00; A47G 7/00

[52] U.S. Cl. ..... 428/17; 47/55; 428/24

[58] Field of Search ..... 24/20 CW, 30.5 W, 23 W; 428/24, 17, 18; 47/55

[56] References Cited

U.S. PATENT DOCUMENTS 2,855,647 10/1958 Smith ..... 24/30.5 W

FOREIGN PATENT DOCUMENTS 228276 5/1960 Australia ..... 24/30.5 W 772643 8/1934 France ..... 428/24

*Primary Examiner*—Henry F. Epstein

*Attorney, Agent, or Firm*—Alvin Sinderbrand

[57] ABSTRACT

An artificial plant is assembled from a main stem member and a plurality of similar auxiliary stem assemblies which are separately molded and have their end portions secured to respective portions of the main stem member at locations spaced apart along the latter. A connector securing each such end portion of an auxiliary stem assembly to said main stem member is in the form of a strip of malleable sheet metal wrapped about the secured together stem portions and having tapering end portions overlapping in side-by-side relation to an extent depending on the thicknesses of the portion of the main stem member and the end portion of the auxiliary stem assembly about which the strip is wrapped.

4 Claims, 6 Drawing Figures

CONNECTORS FOR ASSEMBLING COMPONENT PARTS OF ARTIFICIAL PLANTS

BACKGROUND OF THE INVENTION

1. Field of the Invention

This invention relates generally to artificial plants or flowers, and more particularly is directed to connectors by which separately formed or molded components of an artificial plant can be secured together.

2. Description of the Prior Art

It has been known to produce artificial plants from stem assemblies which are molded of plastic, frequently about wire cores, and on which separately formed leaves or foliage and blooms or flowers are mounted. When the stem assemblies are molded of plastic, as aforesaid, the cost of the dies or molds practically limits the size and varieties of stem assemblies that are produced.

Therefore, it has been suggested to provide an artificial plant from an elongated main stem member, and a plurality of similar, separately molded or otherwise formed auxiliary stem assemblies adapted to have foliage and blooms mounted thereon and having respective end portions secured to portions of the main stem member at locations spaced apart along the latter. By varying the number and positions of the similar or even identical auxiliary stem assemblies on the main stem member, the size and appearance of the resulting artificial plant can be desirably varied even though the auxiliary stem assemblies are produced or molded by means of a single die or mold cavity. However, if the end portions of the auxiliary stem assemblies are secured to the main stem member by means of the conventionally used lengths of soft wire wrapped therearound, the assembling of the artificial plants becomes time consuming and hence relatively costly.

OBJECTS AND SUMMARY OF THE INVENTION

Accordingly, it is an object of this invention to provide an artificial plant arrangement which avoids the previously mentioned disadvantages of the prior art.

More specifically, it is an object of this invention to provide an improved connector for conveniently securing together stem portions of an artificial plant, for example, for securing the end portion of a molded auxiliary stem assembly at a suitable location on a main stem member.

In accordance with an aspect of this invention, a connector for securing together stem portions of an artificial plant, as noted above, comprises a strip of malleable sheet metal adapted to be wrapped about the stem portions which are to be secured together and having tapering end portions which overlap in side-by-side relation to an extent depending on the thicknesses of the secured together stem portions.

In a desirable embodiment of the invention, the strip of malleable sheet metal has a planform in the shape of an oblique parallelogram so that the tapering end portions thereof have inclined edges which are in parallel, abutting relation when the strip is wrapped about the stem portions to be secured to each other. Moreover, the strip constituting a connector in accordance with this invention is desirably initially bent into a substantially U-shaped configuration with the tapering end portions thereof extending generally parallel to each other in spaced apart relation for receiving the stem portions therebetween.

The above, and other objects, features and advantages of the invention, will be apparent in the following detailed description of an illustrative embodiment when read in connection with the accompanying drawing in which corresponding parts are identified by the same reference numerals in the several views of the drawing.

DETAILED DESCRIPTION OF A PREFERRED EMBODIMENT

Figure 5:
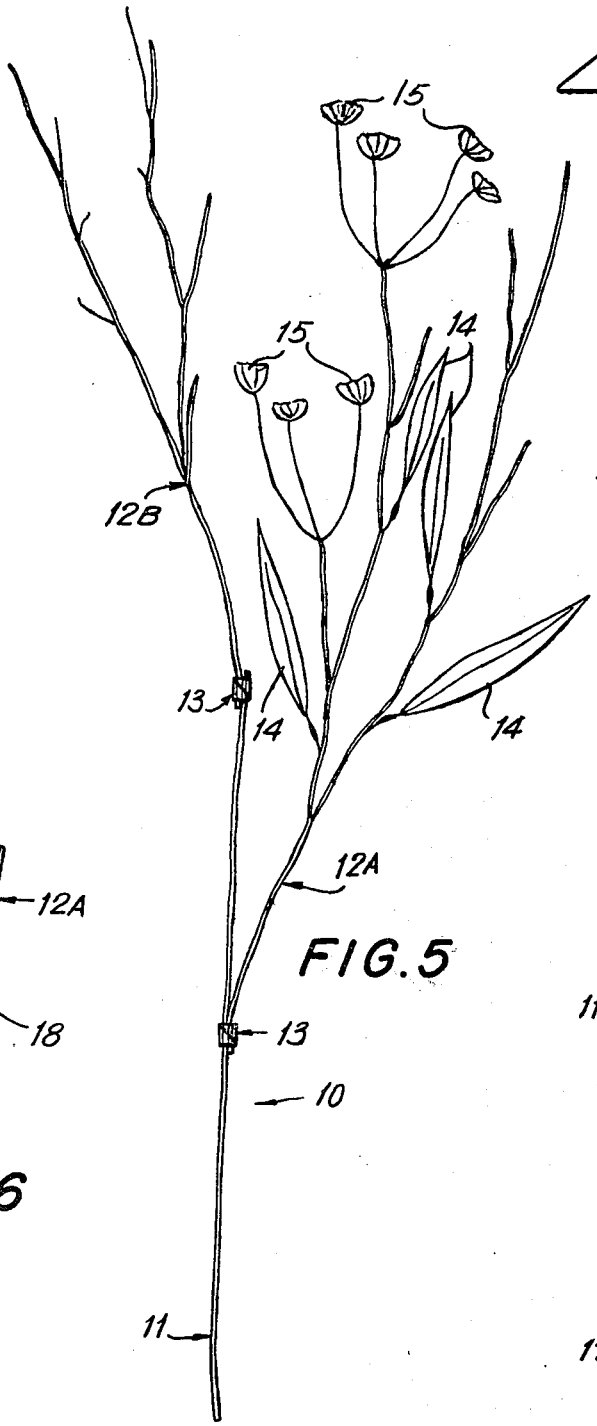
FIG. 5 is an elevational view of an artificial plant having stem portions thereof secured together by connectors in accordance with the present invention.

Referring to the drawing in detail, and initially to FIG. 5 thereof, it will be seen that an artificial plant 10 in accordance with an embodiment of this invention may be formed of an elongated main stem member 11 and a plurality of auxiliary stem assemblies 12A and 12B which may be similar or identical to each other, and which have respective end portions secured to main stem member 11 at selected locations along the latter by means of connectors 13.

Figure 3:
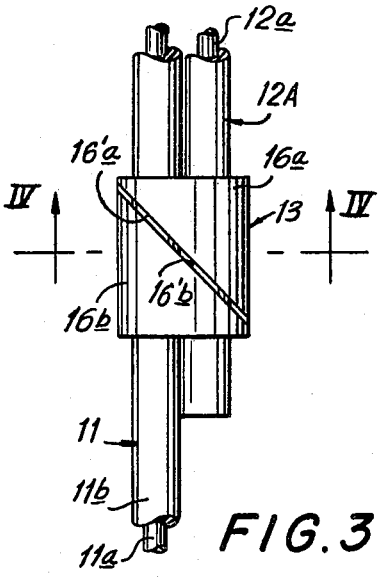
FIG. 3 is a side elevational view illustrating the connector of FIG. 2 operatively positioned for securing together stem portions of an artificial plant.
Figure 4:
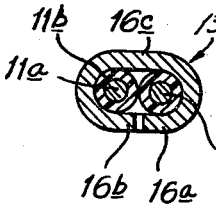
FIG. 4 is a sectional view taken along the line IV–IV on FIG. 3.

The main stem member 11 is desirably formed of a wire core **11*a* with a plastic wrapping or coating 11*b* thereon (FIGS. 3 and 4). Each of the auxiliary stem assemblies 12A and 12B is desirably molded of plastic with a wire core 12*a* being preferably provided at least within relatively thick portions of the respective stem assembly. The stem assemblies 12A and 12B may be identical, and hence produced in a single mold, but are variously positioned in respect to main stem member 11 so as to provide a desirably varied appearance and size to the resulting artificial plant 10. The auxiliary stem assemblies 12A and 12B are shown to terminate in relatively thin or fine twigs or stem portions on which separately molded leaves or foliage 14 and flowers or blooms 15 may be conventionally mounted, for example, as shown in respect to auxiliary stem assembly 12A**.

Figure 1:
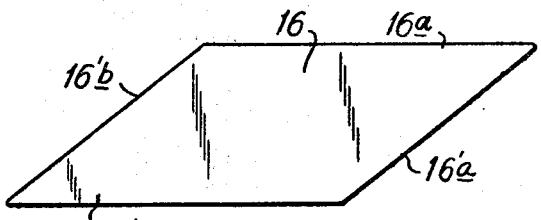
FIG. 1 is an enlarged plan view of a metal strip adapted to form a connector in accordance with an embodiment of this invention, and which is shown in a flat condition.

In accordance with the present invention, each of the connectors 13 is shown to be formed of a strip 16 of malleable sheet metal which, in planform or when flat, as shown on FIG. 1, has the shape of an oblique parallelogram to define tapering end portions **16*a* and 16*b* at the opposite ends of the strip 16. As shown on FIG. 2, strip 16 is initially bent into a substantially U-shaped configuration so that the mid-portion of strip 16 forms a bight 16*c* from which the tapering end portions 16*a* and 16*b* extend substantially parallel to each other in spaced apart relation. By reason of the described shape of strip 16 when in its flat condition, the inclined edges 16'a and 16'b of tapering end portions 16a and 16b, respectively, are angled relative to each other when the respective end portions 16a and 16b are disposed in parallel planes, as shown on FIG. 2**.

When using the connector 13 according to this invention, for example, for securing the base end portion of auxiliary stem assembly 12A to main stem member 11 at a selected location along the latter, the base end portion of stem assembly 12A and the respective portion of main stem member 11 are inserted side-by-side between parallel, spaced apart tapering end portions 16a and 16b of connector 13 so as to seat against the bight portion 16c thereof. Then, end portions 16a and 16b are further bent in opposed directions, for example, in the directions of the arrows 17a and 17b on FIG. 2, so as to complete the wrapping of connector 13 about the stem portions which are to be secured together thereby. Such wrapping of connector 13 about the stem portions to be secured together thereby may be effected by conventional pliers or by a special tool provided therefor. In either case, when the wrapping of connector 13 about the stem portions to be secured thereby, that is, about a portion of main stem member 11 and the base end portion of stem assembly 12A has been completed, the tapering end portions 16a and 16b of the malleable metal strip 16 overlap in side-by-side relation, as shown on FIG. 3, to an extent depending on the thicknesses of wrapped portions of main stem member 11 and stem assembly 12A, and the inclined edges 16'a and 16'b of such tapering end portions are then in parallel, abutting relation.

Figure 2:
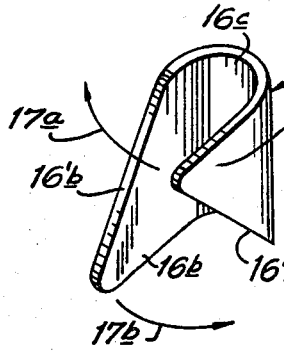
FIG. 2 is a perspective view of a connector according to this invention formed from the flat strip of FIG. 1, and which is shown prior to its use for securing together stem portions of an artificial plant.

It will be appreciated that the connector 13 according to this invention can be simply and conveniently manipulated from its initial position shown on FIG. 2 to its closed or clamping position shown on FIGS. 3 and 4 for conveniently and economically securing the several stem portions to each other. Moreover, when connector 13 is in its closed or clamping position, as on FIGS. 3 and 4, the overlapping tapered end portions 16a and 16b ensure that the connector 13 will provide a relatively smooth contour or surface even though the thicknesses of the stem portions secured together thereby may vary.

Figure 6:
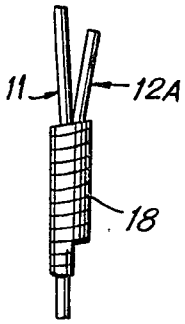
FIG. 6 is an enlarged fragmentary elevational view illustrating a finished joint at which stem portions of the artificial plant shown on FIG. 5 are secured together by a connector according to this invention.

After each connector 13 has been closed or clamped to secure the respective stem portions to each other, the resulting joint may be wrapped or enveloped in suitable plastic or paper tape, as at 18 on FIG. 6, for enhancing the natural appearance of the resulting joint of the artificial plant.

Although an illustrative embodiment of this invention has been described in detail herein with reference to the accompanying drawing, it is to be understood that the invention is not limited to that precise embodiment, and that various changes and modifications may be effected therein by one skilled in the art without departing from the scope or spirit of the invention as defined in the appended claims.

What is claimed is:

1. An artificial plant comprising an elongated main stem member; a plurality of similar, separately formed auxiliary stem assemblies having respective end portions to be secured to portions of said main stem member at respective locations spaced apart along the latter; and connectors securing said end portions of the auxiliary stem assemblies to said portions of the main stem member at said respective locations and each consisting of a strip of malleable sheet metal wrapped about the respective portion of said main stem member and the respective end portion of an auxiliary stem assembly and having tapering end portions which overlap in side-by-side relation to an extent depending on the thicknesses of said portion of the main stem member and said respective end portion of an auxiliary stem assembly secured together thereby.

2. An artificial plant according to claim 1; in which each of said connectors and the stem portions secured together thereby are enveloped in tape wound thereabout.

3. An artificial plant according to claim 1; in which said strip of each of said connectors has a planform in the shape of an oblique parallelogram so that the tapering end portions thereof have inclined edges in parallel, abutting relation when wrapped about the stem portions secured together thereby.

4. An artificial plant according to claim 1; further comprising foliage and blooms mounted on each of said auxiliary stem assemblies.

* * * * *